United States Patent [19]

Dietzel et al.

[11] 3,953,224

[45] Apr. 27, 1976

[54] EXTRACTION TOWER FOR SUGAR BEETS COSSETTES OR CRUSHED SUGAR CANE

[75] Inventors: Walter Dietzel; Siegfried Matusch, both of Braunschweig, Germany

[73] Assignee: Braunschweigische Maschinenbauanstalt, Braunschweig, Germany

[22] Filed: Mar. 7, 1975

[21] Appl. No.: 556,301

[30] Foreign Application Priority Data

Mar. 16, 1974 Germany ..... 2412738

[52] U.S. Cl. ..... 127/5; 23/267 R; 23/270 R; 127/3

[51] Int. Cl.[2] ..... C13D 1/12

[58] Field of Search ..... 127/2–7; 23/267 R, 270 R

[56] References Cited

UNITED STATES PATENTS

| | | | |
|---|---|---|---|
| 2,819,190 | 1/1958 | Kather | 127/7 |
| 3,493,345 | 2/1970 | Windley | 23/230 R |
| 3,726,715 | 4/1973 | Mushack | 127/5 |
| 3,794,521 | 2/1974 | Dietzel | 127/5 |

OTHER PUBLICATIONS

Sugar Industry Abstracts, 15(4), abstract 208 (1953).

*Primary Examiner*—Morris O. Wolk
*Assistant Examiner*—Sidney Marantz
*Attorney, Agent, or Firm*—W. G. Fasse; W. W. Roberts

[57] ABSTRACT

An extraction tower for the counter-current leaching of sugar beets cossettes or crushed sugar cane. The elements which convey the material to be leached through the tower, especially the conveyor screw means and/or the baffle means which are arranged for cooperating with the conveyor screw means are provided with load sensor means, such as strain gauge elements which through control amplifier means control the drive means for the conveying elements to adapt the through-put and thus the conveying to the loads occurring throughout the tower. Even the pump and valve means may be controlled in response to such strain gauge means.

11 Claims, 3 Drawing Figures

EXTRACTION TOWER FOR SUGAR BEETS COSSETTES OR CRUSHED SUGAR CANE

BACKGROUND OF THE INVENTION

The present invention relates to extraction towers for sugar beets cossettes or crushed sugar cane to be leached in a counter-current fashion. To this end the conveying means in the tower comprise a central shaft rotatably supported coaxially in the tower. The shaft carries a plurality of conveying elements in the form of wing or worm screw flights. Additional conveying elements are secured to the inner surface of the housing forming the tower. These additional conveying elements comprise guide plates or baffle plates pivotally held in bearings for tilting about their longitudinal axis, said bearings being secured to the wall of the tower. The guide or baffle plates are arranged to reach into the spaces intermediate the wing or worm screw flights for cooperation with these flights to convey the material to be leached in an upward direction against the leaching liquid flowing downwardly through the tower.

Several different modifications of extraction towers of the above type have become known whereby, for the purpose of avoiding jamming and the destruction of the sugar beets cossettes, the tower has been subdivided into a lower stirring zone and into an upper extraction zone adjacent to the stirring zone. The two zones are directly connected with each other. However, different type conveying elements are employed in the stirring zone and in the extraction zone whereby such different conveying elements are either secured to the central shaft or to the inner wall of the extraction tower, please see for example German Patent 1,017,549.

In spite of employing different conveying elements in different zones of an extraction tower, which might even include in addition to the stirring and extraction zone a discharge zone, it has not quite been possible heretofore to avoid local compacting or damming of the material, especially of the cossettes. Such local compactions may, for example, be caused by the fact that the cossettes have irregular dimensions or by the fact that the cossettes have different consistencies, for example, due to influences occurring at the time of pretreatment of the cossettes or due to the fact that different types of sugar beets are being used.

In order to achieve a substantially faultless operation of the tower it is necessary that the extraction or leaching liquid may flow downwardly through the entire cross sectional area of the tower in a uniform distribution through the material to be leached which is conveyed upwardly in the tower whereby simultaneously a sufficient residence time of the material in the tower must be assured. Any non-uniform compaction throughout the body of material being conveyed impairs the result of the extraction and its efficiency. In many instances compaction causes the destruction of the cossettes so that the latter are completely mashed thereby increasing the mashed pulp proportion relative to the useful cossettes. Such increased proportion of pulp impairs the further treatment of the juice as well as of the cossettes.

The above mentioned use of different conveying means in the individual zones of the tower improves the uniformity of the throughput as well as the uniform distribution of the material over the cross section of the tower as compared to prior art towers employing the same conveying means throughout the length of the tower. However, the tower comprising several zones and several different types of conveying means is rather expensive in its construction and in addition even the additional expense does not sufficiently assure that local compaction of the material to be leached is avoided with certainty.

OBJECTS OF THE INVENTION

In view of the foregoing, it is the aim of the invention to achieve the following objects singly or in combination:

to avoid the drawbacks of the prior art, especially the localized compaction of the material to be leached and thus the destruction of the sugar beets cossettes by pulping;

to provide an extraction tower which will assure a uniform distribution and fluffiness of the material to be leached throughout the volume of the tower regardless whether uniform conveying means are used all along the length of the tower or whether different conveying means are employed in individual zones of the tower;

to provide guide or baffle plates which are adjustable in their angle of incidence in order to reduce or increase the degree of compaction locally throughout the hight of the tower; and to arrange strain gauge elements, such as foil strain gauges in the conveying means for sensing localized stress in the conveying means and to employ the resulting electrical signal for the control of the material conveying means.

SUMMARY OF THE INVENTION

According to the invention there is provided an extraction tower for sugar beet cossettes or crushed sugar cane in which at least a few of the guide plates or baffle plates and/or the wing or the worm screw flights of the conveying means are provided with sensors responsive to pressure or bending stresses. The sensors are connected to a control apparatus, such as an amplifier circuit, for influencing the consistency and/or the quantity of the material to be treated. The respective signal may also be used for controling additionally or separately the position of certain conveying elements and/or for influencing the driving speed of the conveying shaft in the tower.

By providing at least a few of the mentioned conveying elements carried by the tower shaft and/or carried on the inner circumference of the tower wall, with sensor or measuring elements it is possible to ascertain local compactions of the material being treated. The local compactions are ascertained in the form of corresponding electrical signals in order to influence through a regulating or control device certain operational values or rather adjustments of the extraction tower. In addition, it is possible to indicate or display such operational or adjustment values. Each compaction of the material causes higher loads for the conveying elements located adjacent to or within the compaction and such higher loads are ascertained by the measuring or sensor means, for example, by sensing a higher pressure on the conveying surface of the conveying elements to which the sensor is secured. In the alternative, the sensors may ascertain the elastic bending of the conveying elements as a result of the material concentration or compaction localized adjacent to such conveying elements or element. In both instances, it is possible to provide a corresponding electrical signal, for example, by making the sensor part of an electrical bridge circuit. The respective electrical signal is then supplied to a control or regulating device, such as an amplifier, the output of which is employed for influencing the drive means or the conveying devices including the movable conveying elements of the tower in such a manner that the compaction or, on the other hand, a too fluffy consistency of the solid-liquid mixture in the tower is removed, for example, by changing the speed of the main shaft in the tower or by changing the angle of incidence of the conveying elements carried by the shaft or by the inner walls of the tower. It is also possible to employ the signal for controlling a valve and/or a pump for influencing the consistency of the solid-liquid mixture.

BRIEF FIGURE DESCRIPTION

In order that the invention may be clearly understood, it will now be described, by way of example, with reference to the accompanying drawings, wherein.

DETAILED FIGURE DESCRIPTION

Figure 1:
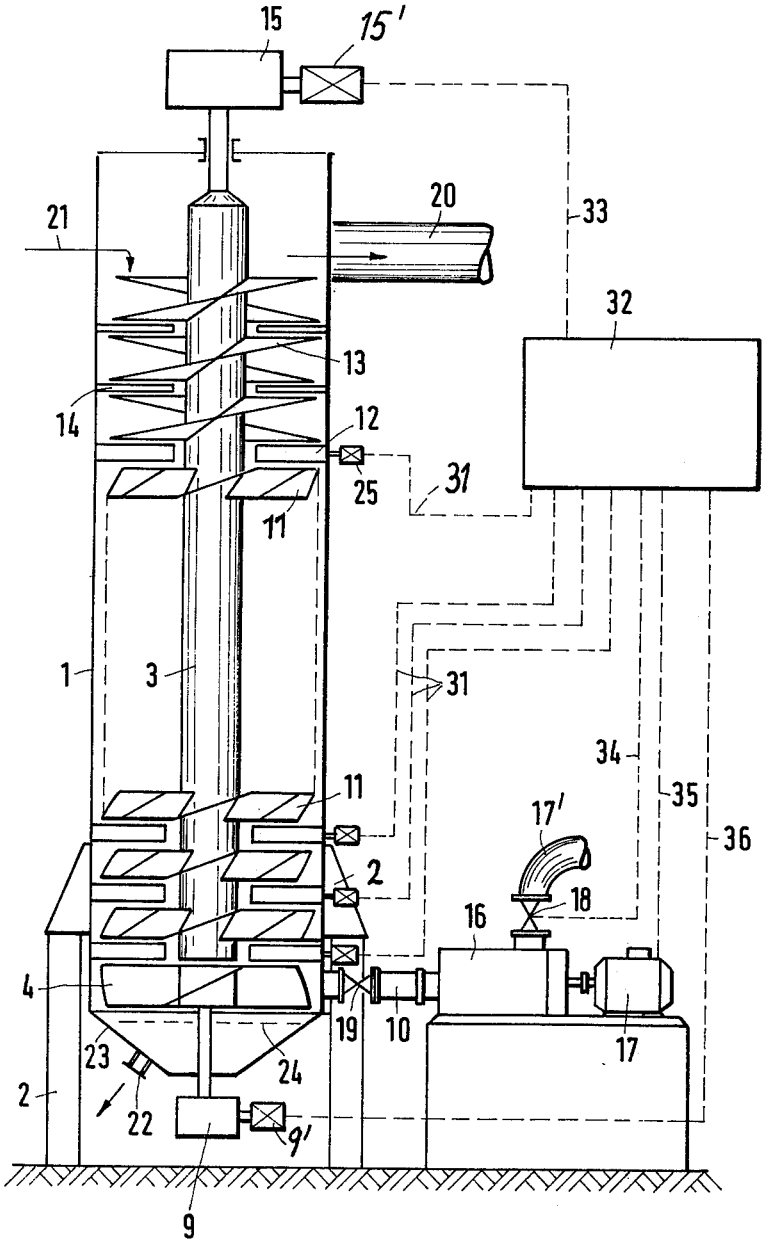
FIG. 1 is a diagrammatic, longitudinal section through a defusion or extraction tower.

In FIG. 1 the housing 1 of the extraction tower is supported on a fouundation by means of brackets 2. A hollow shaft 3 is rotatably secured in the tower. The shaft 3 supports along its length and thus along the height of the tower, conveying elements of differing construction. Further, the hollow shaft 3 comprises two different sections driven independently of each other. The lower section is provided with a distribution and lifting wing 4 which is rotated by separate drive means 9. The purpose of the wing 4 is to uniformly distribute the cossettes supplied to the pipe 10 over the cross-sectional area of the tower and to simultaneously lift the cossettes upwardly into the extraction zone of the tower. In the extraction zone, which extends above the wing 4, the shaft is provided with paddle wheels 11 spaced from each other in such a manner that buffle plates or guide plates 12 extending from the inner wall of the tower housing 1 inwardly may reach into the spaces between the paddle wheels. Above the extraction zone the tower comprises a discharge zone in which the hollow shaft 3 is provided with spaced or interrupted worm screw flights 13 which again cooperate with baffle plates 14 extending inwardly from the wall of the tower housing.

The upper part of the shaft 3 is driven by a separate drive mechanism 15 including a motor 15'. The drive 9 for the lower screw flight 4 also includes a separate motor 9'.

The supply of cossettes which normally comes from a meshing apparatus through a supply conduit 17' is pumped into the tower by a pump 16 driven by a pump motor 17 and connected to the the tower through a supply pipe 10 and a controllable valve 19. The supply conduit 17' is connected to the pump 16 also by means of a controllable valve 18. The pump motor 17 is controllable as will be described in more detail below.

Figure 2:
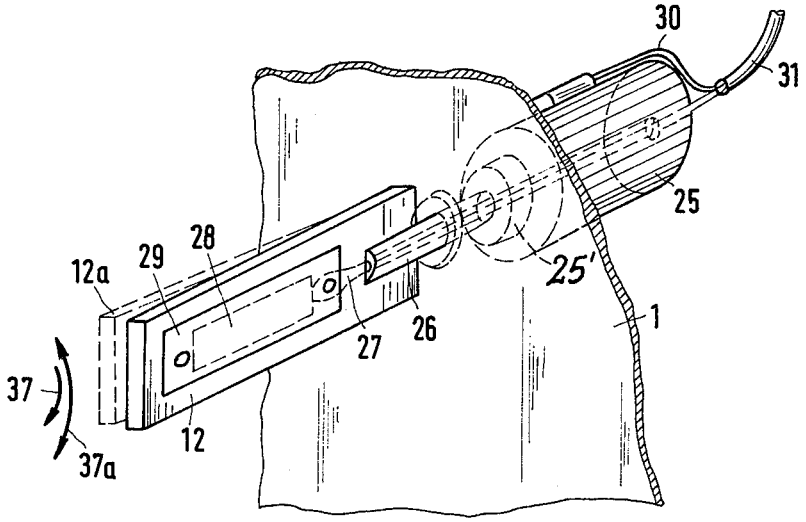
FIG. 2 shows on a somewhat enlarged scale and in a perspective view a baffle or guide plate of the tower provided with a servo motor and a built-in sensor.

The leached or extracted material is removed at the upper end of the tower through a discharge duct 20. The leaching liquid which flows in a counter-current direction relative to the material being treated is supplied to the cup end of the tower through a conduit 21. The juice is removed from the bottom of the tower by means of an outlet port 22 connected to a juice collecting chamber 23 the top of which is covered by a sieve or strainer 24. As shown in FIG. 1, the guide plates or baffle plates 12 in the right hand part of the tower 1 are connected through shafts to individual motors 25. As best seen in FIG. 2, the shafts extend through the wall of the tower 1 and are rotatably held by means of leak-proof bearings 25'. The motors 25 are secured to the outer surface of the tower by conventional means not shown.

Referring specifically to FIG. 2, each motor driven baffle plate 12 comprises a plane, relatively flat rod secured to the free end of the drive shaft 26 of the respective motor 25. The drive shaft 26 is a hollow shaft through which a conductor 27 extends. The conductor 27 is connected to its respective strain gauge 28 secured in a recess of the baffle plate 12 by means of a removable lid 29. Such strain gauges are well known in the art and able to detect relatively slight flextures in the plates and to convert such flextures into corresponding electrical signals. The measuring conductors 27 extend through the motor and into a cable 31 which comprises further conductors 30 for controlling and energizing the motor 25. The cable 31 connects the motor 25 and the strain gauge 28 to the control and regulating device 32. If the material being treated becomes compacted adjacent to the baffle plates 12, the latter are subjected to increase pressure so that they are deflected or bent into a position 12*a* shown in dashed lines in FIG. 2. This deflection is sensed by the sensor strain gauge 28, which as a result, transduces or converts the mechanical deflection into an electrical signal proportional to the deflection and the signal is supplied to the control apparatus 32 through the conductor 27. The control device 32 may comprise a conventional indicator, such as a voltage meter, for displaying the measured deflection representing values. Further, the control device 32 comprises amplifier circuits and, if desired, comparison or discriminator circuits for controlling the respective drive motors either directly as a function of the measured result or in response to comparing the measured signals with given signal values which may, for example, be stored in a memory in the control device 32. The amplifiers, the comparing circuits, and any memory means which may be combined in the control device 32 are well known as such. The control device 32 comprises a plurality of output circuits 33, 34, 35 and 36 as well as 30. The output circuits or conductors 30 are connected to the drive motors 25 of the baffle or guide plates 12 for adjusting the angle of incidence by tilting the plates 12 in the direction of the arrows 37 or 37*a*. The output conductor 33 is connected to the motor 15' for controlling or regulating the rpm of the hollow shaft 3. The output conductor 34 is connected to a valve control means, such as a solenoid or the like for the valve 18 whereby the latter may be opened and closed to vary the quantity of the supply of the mashed material. The output conductor 35 is connected to the pump motor 17 to provide an alternative possibility of controlling the supply of material into the tower. The output conductor 36 is connected to the motor 9' for individually controlling the drive means 9 of the screw wing 4.

It will be appreciated that the particular, measured irregularity will determine which of the above mentioned possibilities of control will be employed for restoring the desired flow pattern and consistency throughout the volume of the tower. Thus, the control of the valve and/or of the baffle or guide plates and/or of the wing or worm screws will depend upon whether only a local, narrowly bounded irregularity has been measured or whether the measured irregularity or irregularities indicate the need for a consistency change over a larger height of the tower requiring a corresponding compaction or loosening over such larger tower section.

Generally, it will not be necessary to provide all baffle plates or guide plates with measuring transducers and motors since the operation of the tower can already be effectively influenced by the adjustment and/or by the drive of only certain of the conveying means, for example, only certain guide plates may require an adjustment. However, it is generally advisable to provide at least a certain number of baffle or guide plates in one plane with measuring transducers and drive so as to effectively vary the consistency of the material in that particular plane of the tower. Incidentally, the baffle or guide plates 12 may be rotated completely as indicated by the arrow 37*a* in FIG. 2 or a mere change of the angular position could be effected in one or the other direction. Further, the strain gauges 28 may also be located in the screw 4 and/or in the wings 11, and/or in the screws 13 and/or in the baffle plates 14. The arrangement would be substantially the same as shown in FIG. 2.

Instead of strain gauges as shown in FIG. 2 the measuring points may be provided with capacitive or inductive measuring transducers which respond to pressure and permit the monitoring of the pressure acting on the baffle or guide plates and/or on the conveying screws in the tower. Such capacitive and inductive transducers are well known in the art and should be arranged on the upstream side of the plates and/or on the upstream side of the screw means as viewed in the direction of feed advance of the material being conveyed through the tower.

In addition to the above described possibilities of controlling the tower, it is also possible to influence apparatus employed for preparing and supplying the cossettes to the pipe 17, that is, apparatus upstream of the pipe 17 and not shown in the present drawings. Where the position of the screw wings is intended to be controlled, the screw wings will be adjustably secured to the shaft 3, so that the pitch angle of the screw wings may be adjusted as desired. In any event, the control device 32 will be programmed so as to provide an automatic control loop responsive to local compaction or excessive loosening of the material being treated.

As mentioned, by the described sensing and control it is possible to provide for a locally confined loosening effect or for a loosening effect in an entire plane of the tower whereby, if desired, the material supply may be temporarily stopped or reduced by controlling the valve 18 or the motor 17, whereby the removal of a local compaction may be greatly facilitated.

Further, the control device 32 may be programmed, for example, by means of discriminator or comparing circuits so that it will respond to the occurrence of local compaction or to a local loosening of the material as a function of predetermined or given reference values which may be stored in a memory in the control device 32. However, the use of reference values is not necessary since the control may respond directly to a compaction or loosening representing signal.

According to another aspect of the invention, the sensors or strain gauges may be part of measuring bridges whereby such bridges may be installed as an integrated circuit into the measuring positions in the tower or the bridge circuit may be included in the control device 32. In any event, the connection between the tower and the control device 32 will merely require the proper installation of the connecting conductors, such as conductors 27 and 30.

Figure 3:
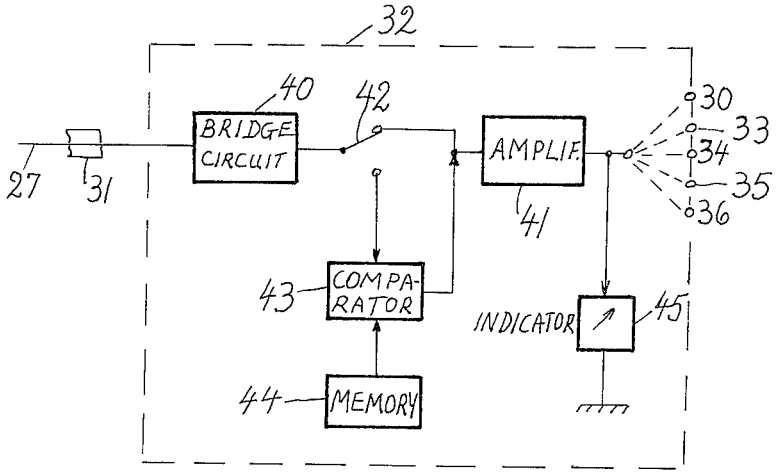
FIG. 3 shows a circuit arrangement of the control device.

FIG. 3 illustrates in somewhat more detail the content of the control circuit 32. Preferably, a bridge circuit 40 is connected to the conductor 27 so that one branch of the bridge circuit is formed by a strain gauge 28. The output of the bridge circuit may be selectively switched to the input of an amplifier 41 which in turn is connectable with its output to any and/or all of the output conductors 30, 33 34, 35 and 36. If desired, the output of the bridge circuit 40 may be switched by means of a switch 42 to one input of a comparator circuit 43, the other input of which is connected to a memory 44. The output of the comparator is also connnected to the input of the amplifier 41. The memory may have stored therein reference signal values corresponding to rated values representing the desired compaction or looseness of the material to be conveyed through the tower. If desired, an indicating instrument 45 may be connected to the output of the amplifier.

Although the invention has been described with reference to specific example embodiments, it is to be understood, that it is intended to cover all modifications and equivalents within the scope of the appended claims.

What is claimed is:

1. An extraction tower for conveying material through a leaching path in counter-current fashion relative to a leaching liquid flow, comprising a tower housing, a plurality of material conveying means including rotatable screw means and tiltably supported baffle means operatively arranged inside said tower for conveying said material through the tower housing, sensor means operatively secured to any of said conveying means to sense loads to which the respective conveying means are subjected in operation inside said tower, control means responsive to said sensor means, drive means individually connected to said material conveying means, and means connecting at least certain of said drive means to said control means for individually regulating said drive means in response to respective load signals received from corresponding ones of said sensor means.

2. The extraction tower according to claim 1, wherein said sensor means are capacitive or inductive sensor means.

3. The extraction tower according to claim 1, wherein said sensor means are arranged in a bridge circuit connected to said control means.

4. The extraction tower according to claim 1, wherein said sensor means are responsive to pressure loads applied to the respective conveying means.

5. The extraction tower according to claim 1, wherein said sensor means are responsive to bending loads applied to the respective conveying means.

6. The extraction tower according to claim 1, wherein said sensor means are strain gauges.

7. The extraction tower according to claim 6, wherein said strain gauges are foil strain gauges.

8. The extraction tower according to claim 1, wherein said material conveying means comprise rotatable screw means in said tower, baffle means supported by said housing inside said tower for cooperation with said screw means, and pump means as well as valve means for controlling the material supply into said tower.

9. The extraction tower according to claim 8, wherein said rotatable screw means comprise a rotatable shaft supported for rotation in the tower, screw flights secured to said shaft and a material spreading screw member supported for rotation in the lower end of said tower, said drive means comprising separate drive motors for said shaft and said screw member, and means connecting said separate drive motors to said control means for driving said shaft and screw member in response to said sensor means.

10. The extraction tower according to claim 8, comprising means pivotally securing said baffle means to said housing in said tower, said drive means including motor means operatively connected to said baffle means and responsive to said control means for pivoting or rotating said baffle means to vary the angle of incidence of said baffle means in response to said sensor means.

11. The extraction tower according to claim 8, wherein said drive means comprise actuating means connected to said valve means and to said pump means as well as to said control means for actuating said valve or pump means in response to said sensor means.

* * * * *